US005842829A

United States Patent [19]

Cunha et al.

[11] Patent Number: 5,842,829

[45] Date of Patent: Dec. 1, 1998

[54] COOLING CIRCUITS FOR TRAILING EDGE CAVITIES IN AIRFOILS

[75] Inventors: Francisco Jose Cunha, Schenectady; David Anthony DeAngelis, Voorheesville, both of N.Y.

[73] Assignee: General Electric Co., Schenectady, N.Y.

[21] Appl. No.: 721,082

[22] Filed: Sep. 26, 1996

[51] Int. Cl.[6] ..... F01D 5/14

[52] U.S. Cl. ..... 415/115; 416/97 R

[58] Field of Search ..... 415/115, 116; 416/92, 96 A, 97 R

[56] References Cited

U.S. PATENT DOCUMENTS

| | | | |
|---|---|---|---|
| 5,125,978 | 6/1992 | Muth et al. . | |
| 5,340,274 | 8/1994 | Cunha . | |
| 5,464,322 | 11/1995 | Cunha et al. | 415/115 |
| 5,488,825 | 2/1996 | Davis et al. | 416/97 R |
| 5,536,143 | 7/1996 | Jacala et al. . | |
| 5,611,662 | 3/1997 | Cunha | 415/115 |
| 5,695,322 | 12/1997 | Jacobson et al. | 416/97 R |
| 5,700,132 | 12/1997 | Lampes et al. | 416/97 R |

*Primary Examiner*—Thomas E. Denion
*Attorney, Agent, or Firm*—Nixon & Vanderhye

[57] ABSTRACT

An airfoil having a trailing edge cavity formed by a leading wall and a trailing edge connected by a pair of side walls which converge at the trailing edge to define a cooling passage of substantially triangular cross section; a plurality of guide vanes arranged within the passage, spaced from the leading wall and trailing edge, and configured so that cooling gas flow introduced a generally radial direction is forced to flow in a direction toward the trailing edge.

6 Claims, 5 Drawing Sheets

COOLING CIRCUITS FOR TRAILING EDGE CAVITIES IN AIRFOILS

TECHNICAL FIELD

This invention relates generally to turbine construction, and more specifically, to cooling arrangements for gas cooled airfoils with trapezoidal and/or triangular shaped cooling passages along the trailing edges thereof.

BACKGROUND

In gas turbine engines and the like, a turbine operated by burning gases drives a compressor which, in turn, furnishes air to one or more combustors. Such turbine engines operate at relatively high temperatures. The capacity of an engine of this kind is limited to a large extent by the ability of the material, from which the higher temperature components (such as turbine rotor blades, stator vanes or nozzles, etc.) are made, to withstand thermal stresses which can develop at such relatively high operating temperatures. The problem may be particularly severe in an industrial gas turbine engine because of the relatively large size of certain engine parts, such as the turbine blades and stator vanes. To enable higher operating temperatures and increased engine efficiency without risking blade failure, hollow, convectively-cooled turbine blades and stator vanes are frequently utilized. Such blades or vanes generally have interior passageways which provide flow passages to ensure efficient cooling whereby all the portions of the blades or vanes may be maintained at relatively uniform temperature.

The traditional approach for cooling blades and vanes (referred to herein collectively as "airfoils") is to extract high pressure cooling air from a source, for example, by extracting air from the intermediate and last stages of a turbine compressor. In modern turbine designs, it has been recognized that the temperature of the hot gas flowing past the turbine components could be higher than the melting temperature of the metal. It is, therefore, necessary to establish a cooling scheme to protect hot gas path components during operation. The invention focuses on gas cooled airfoils, and particularly those with trapezoidal or triangular cooling passages along trailing edges of such airfoils.

In general, compressed air is forced through small cavities close to the trailing edges of gas turbine airfoils for cooling. These trailing edge cavities assume trapezoidal (usually generally triangular) cross sectional areas with extremely low acute wedge angles, of less than 5°. Other cavities not necessarily at the trailing edge but located nearby in the airfoil can also assume similar geometrical attributes. In cooling passages having such geometrical attributes, poor cooling flow distribution results in excessive airfoil metal temperatures, resulting in premature loss of component life.

Examples of cooling circuits for gas turbine airfoils, including stator vanes, may be found in U.S. Pat. Nos. 5,125,798; 5,340,274; and 5,464,322.

DISCLOSURE OF THE INVENTION

It is the object of this invention to circumvent the above cooling problems by utilizing guide vanes placed radially in the trailing edge cavity of hollow airfoils to force flow in a more efficient way towards the apex or the convergent points of a triangular/trapezoidal cooling passage. As cooling flow proceeds toward these hard to cool areas, the cooling function is performed by convection.

Several cooling arrangements are described in this application. Each arrangement is designed for incorporation within an airfoil which has a triangular/trapezoidal trailing edge cooling passage with acute wedge angles of less than about 5°.

In accordance with a first exemplary embodiment, a series of small guide vanes are located in the radially outer portion of the trailing edge cooling passage or cavity of the airfoil and are arranged to force flow supplied from the top of the vane towards the apex of the triangular passage. A pair of larger guide vanes or flow splitters located substantially midway of the blade in the radial direction, cooperating to form discharge channels, force most of the cooling gas to return towards the leading wall of the vane cavity. A substantial portion of the cooling gas is then forced to flow back toward the trailing edge through another series of relatively small guide vanes located radially inwardly of the flow splitters. The cooling gas is then returned toward the leading wall of the cavity by another pair of flow splitters arranged similarly to the first pair of splitters. The cooling gas is then free to expand toward the trailing edge at the radial inner portion of the airfoil, before flowing out of the airfoil at the radially inner end thereof. All of the guide vanes and flow splitters in this first embodiment extend fully between the interior side walls of the airfoil.

It was found, however, that this design was not totally effective in forcing flow towards the trailing edge in that very large pressure drops were located in the discharge channels instead of being located along the guide vanes and towards the convergent portion of the airfoil cavity.

In a second disclosed embodiment, additional guide vanes are employed in the trailing edge cavity of the airfoil to force the flow against the convergent points of the trailing edge. Specifically, three sets of guide vanes are arranged in vertically spaced relationship within the trailing edge cavity to cause the cooling gas to follow a generally serpentine path from the radially outer end to the radially inner end of the airfoil. Each set of guide vanes includes vanes of increasing length in the flow direction, with some radial flow permitted around both the leading and trailing edges of each guide vane. Here again, all of the guide vanes extend fully between the side walls of the airfoil. However, in this case, most of the cooling gas escapes from the trailing edge after passing the first series of guide vanes and particularly after passing the final or longest guide vane of the first set. This is because the resistance offered by the converging airfoil walls was too difficult to overcome by the gas which found lower resistance flow paths away from the trailing edge. In addition, hot spots were found to exist behind at least the first set of guide vanes nearest the radially outer end of the airfoil.

In third and fourth preferred embodiments, the problems of the first two embodiments as described above are substantially circumvented. In the third embodiment, the guide vanes do not span the trailing edge cavity from wall to wall. Rather, ribs are provided on the opposed inner surfaces of the cavity, in generally matched pairs, inclined downwardly in the direction of flow towards the trailing edge. These ribs can be formed in horizontally aligned or horizontally offset pairs. In addition, the height of the guide vanes (in the horizontal direction, measured as the extent of the projection of the rib toward the opposite side wall and transverse to the direction of flow) is selected to be greater than the boundary layer height of the flow passing radially downward, thus providing a means to trap the flow with lower momentum, and effectively forcing this trapped flow towards the apex of the trailing edge cavity.

The guide vanes in this third embodiment do not span the length of the entire cavity, thus allowing the trapped flow to spill over towards the apex of the passage. The cooling of the apex is therefore controlled by the height of the guide vanes and their relative orientation.

In the fourth embodiment, the trailing edge cavity is divided into two adjacent trapezoidal passages. Each passage has its own guide vane arrangement, substantially as described above in connection with the third embodiment. This arrangement is achieved by partitioning the trailing edge cavity by a single radially extending rib. Communication holes are located in the radial rib separating the two cavities to improve cross flow along the guide vanes in the trailing passage for improved flow distribution and cooling. With the guide vane arrangements described above for the third and fourth embodiments, hot spots behind the guide vanes are substantially eliminated.

It is also a feature of this invention to provide, optionally, a plurality of apertures at the trailing edge of the airfoil, in the radial outermost portion of the airfoil. This arrangement reattaches the boundary layer to the blade walls to thereby provide effective film cooling along the trailing edge.

Thus, in accordance with its broader aspects, the invention relates to an airfoil having a trailing edge cavity formed by a leading wall and a trailing edge connected by a pair of side walls which converge at said trailing edge to define a cooling passage of substantially triangular cross section; a plurality of wall guide vanes arranged within the passage, spaced from the leading wall and trailing edge, and configured so that cooling gas flow introduced in a generally radial direction is forced to flow in a direction toward the trailing edge.

In another aspect, the invention relates to an airfoil for a gas turbine having a trailing edge cavity formed by a leading wall and a trailing edge connected by a pair of side walls which converge at the trailing edge to define a cooling passage of substantially triangular cross section; a first plurality of guide vanes projecting into the cavity from one side wall toward the other side wall; and a second plurality of guide vanes projecting from the other side wall towards the first side wall; wherein none of the first and second plurality of guide vanes overlap in a direction transverse to a direction of flow of cooling fluid through the airfoil.

Other objects and advantages of the invention will become apparent from the detailed description which follows below.

BEST MODE FOR CARRYING OUT THE INVENTION

Figure 1:
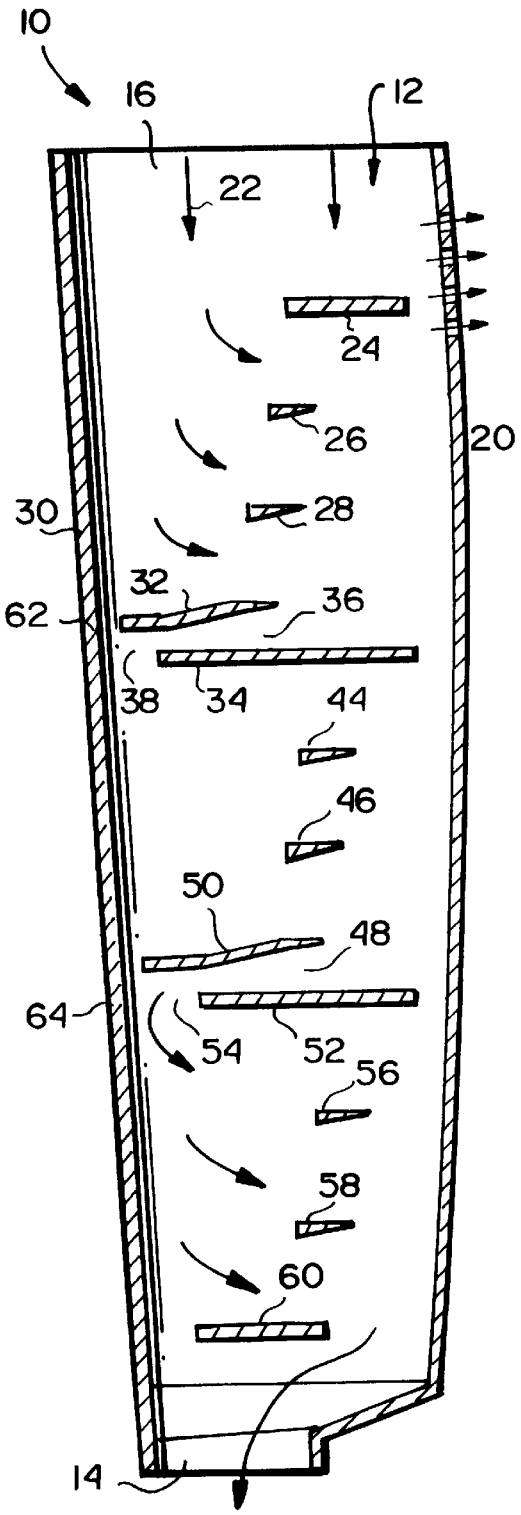
FIG. 1 is a cut away side view of a trailing edge cavity in a gas cooled airfoil in accordance with a first embodiment of the invention.
Figure 2:
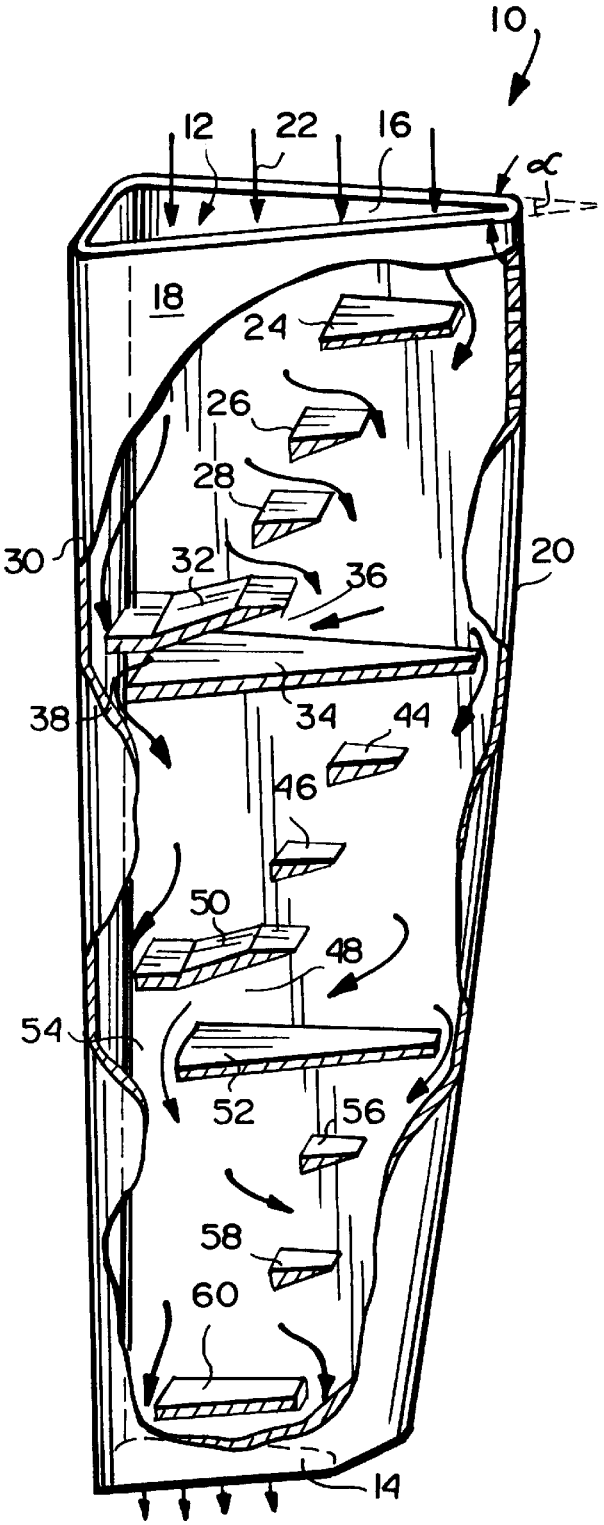
FIG. 2 is a perspective view of the arrangement shown in FIG. 1.

With reference now to FIGS. 1 and 2, a gas turbine airfoil (e.g., a stator vane) trailing edge cavity 10 is shown with a radial inlet 12 at the radially outer end thereof and a radial outlet 14 at the radially inner end thereof. The airfoil is hollow, and the cavity has a generally triangular cross sectional shape, with the specific area of concern the trailing edge portion where the side surfaces 16 and 18 converge at a trailing edge 20, defining an angle a at the edge of about (and generally less than) 5°.

Cooling flow into the trailing edge cavity of the airfoil is from above, as indicated by flow arrows 22, and is initially split by a splitter 24. The cooling gas is forced toward the apex (or trailing edge) 20 of the passage by a first set of two guide vanes 26 and 28 extending between the side walls 16 and 18 of the passage, in an area close to the inlet 12. The splitter 24 and guide vanes 26, 28 are staggered vertically in an upper region of the passage, with splitter 24 closest to the trailing edge and vane 28 closest to the leading wall 30 of the cavity or passage. The splitter 24 and vanes 26, 28 are oriented substantially horizontally, and the guide vanes 26 and 28 are somewhat wedge-shaped, tapering to a point in the direction of the trailing edge 20.

Radially below or radially inward of the guide vanes 26 and 28 are a pair of flow splitters 32 and 34. These splitter devices define a return channel 36 which causes a flow direction change (back to the left in FIGS. 1 and 2) toward the leading wall 30 of the cavity, so that the flow passes through an inlet 38 into the next radial section of the circuit. Now the flow moves to the right, toward trailing edge 20 with the aid of a pair of wedge-shaped guide vanes 44 and 46 before entering another return channel 48 formed by flow splitters 50 and 52 which are similar in construction and relative location to the flow splitters 32 and 34. The flow now passes through another inlet 54 and into the final section where a pair of wedge-shaped guide vanes 56 and 58 direct the flow back toward the trailing edge 20. The final guide 60 diverts most of the flow to the outlet 14.

Generally, the wedge-shaped guide vane sets 26, 28; 44, 46; and 56, 58 are in vertical or radial alignment, while flow splitter sets 32, 34 and 50, 52 are also in general vertical alignment.

It should be noted that flow bypasses are also provided adjacent flow splitter 32 at 62; and adjacent flow splitter 50 at 64, permitting a small amount of cooling gas to bypass the otherwise serpentine flow path and to travel radially along the passage.

The above described arrangement has not produced completely satisfactory results, however. Using conventional pressure test techniques, it has been found that this design is not totally effective in forcing coolant flow towards the trailing edge 20. Very large pressure drops were located in the discharge channels 36, 48 instead of being located along the guide vanes 26, 28, 44, 46, 56 and 58 and towards the convergent portion of the channel adjacent the apex or trailing edge 20. Only modest pressure drops are produced along the apex or trailing edge of the cooling passage, indicating insufficient cooling.

Figure 3:
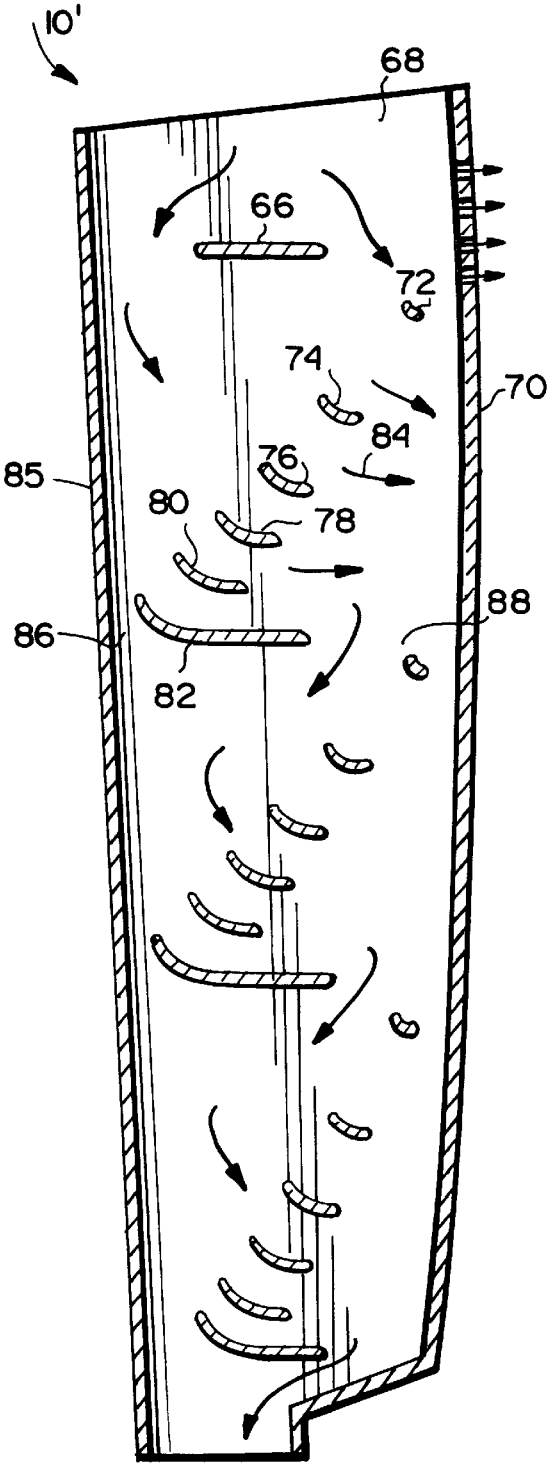
FIG. 3 is a side view, cut away to show the internal guide vanes in a trailing edge cavity of a turbine airfoil in accordance with a second embodiment of the invention.
Figure 4:
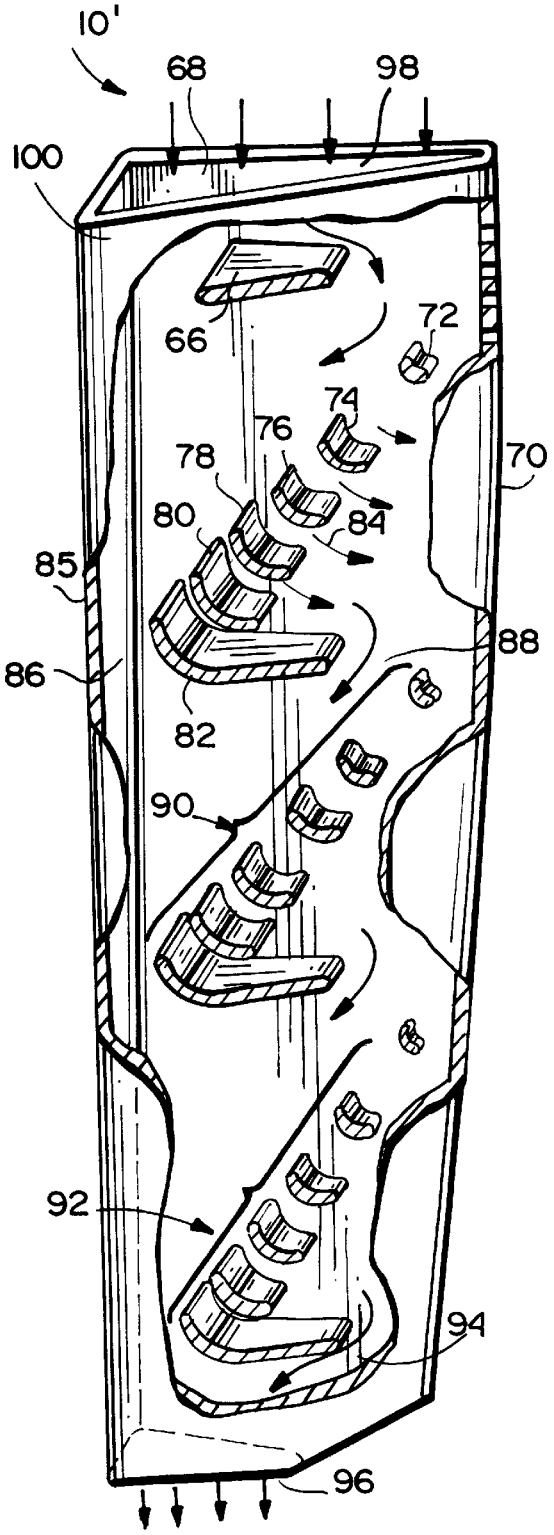
FIG. 4 is a partially cut away perspective view of the airfoil shown in FIG. 3.

Turning now to FIGS. 3 and 4, an alternative cooling arrangement is illustrated. Here, additional guide vanes have been provided to force the cooling air flow toward the apex or convergent points of the trailing edge. Specifically, the hollow airfoil trailing edge cavity 10' is provided with an initial flow splitter 66 located adjacent the inlet 68 in the radially outer end of the cavity. The splitter 66 divides the flow such that some of the cooling gas flow is forced immediately toward the apex or trailing edge 70. A series of initially short but progressively larger guide vanes 72, 74, 76, 80 and 82 direct most of the remaining portion of the originally split cooling gas flow towards the trailing edge as indicated by the flow arrows 84. These guide vanes are staggered from right to left in a radially inward direction as shown in FIG. 3, with a flow bypass 86 (for small amounts of cooling gas) between the longer guide vane 82 and the forward edge 85 of the trailing edge cavity. The flow is generally reversed at an outlet area 88 back toward the leading wall 84 of the cavity or passage. The flow is then redirected toward the trailing edge by a second similar set of guide vanes, collectively indicated by 90, reversed and then redirected toward the trailing edge 70 by a third similar set of guide vanes, collectively indicated by 92. At an outlet 94, flow is redirected to the vane outlet 96.

While the above described second circuit results in better performance that the first described circuit, some problems remain. For example, the flow resistance offered by the converging airfoil walls 98, 100 was difficult to overcome by flow which found a lower resistance path through the outlet 88 and away from the trailing edge 70, once past vane 82. In addition, because the guide vanes connect both airfoil walls 94, 96, hot spots were identified behind at least the first set of guide vanes 72–82 and splitter 66.

Figure 5:
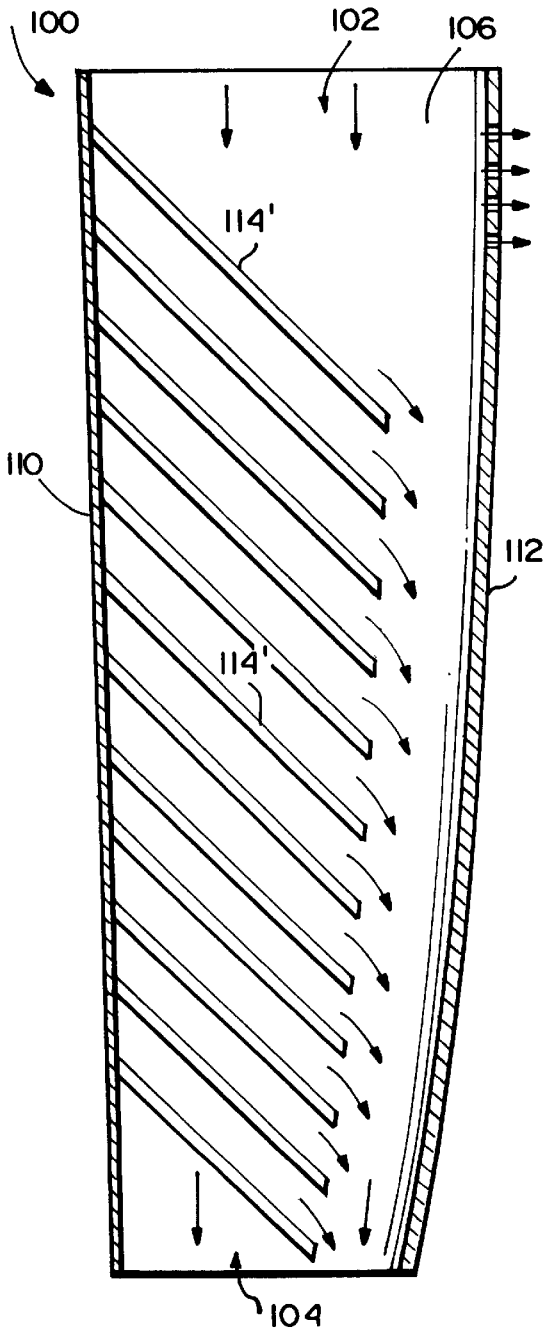
FIG. 5 is a side view of a trailing edge cavity of a turbine airfoil, partially cut away to illustrate a third embodiment of the invention.
Figure 6:
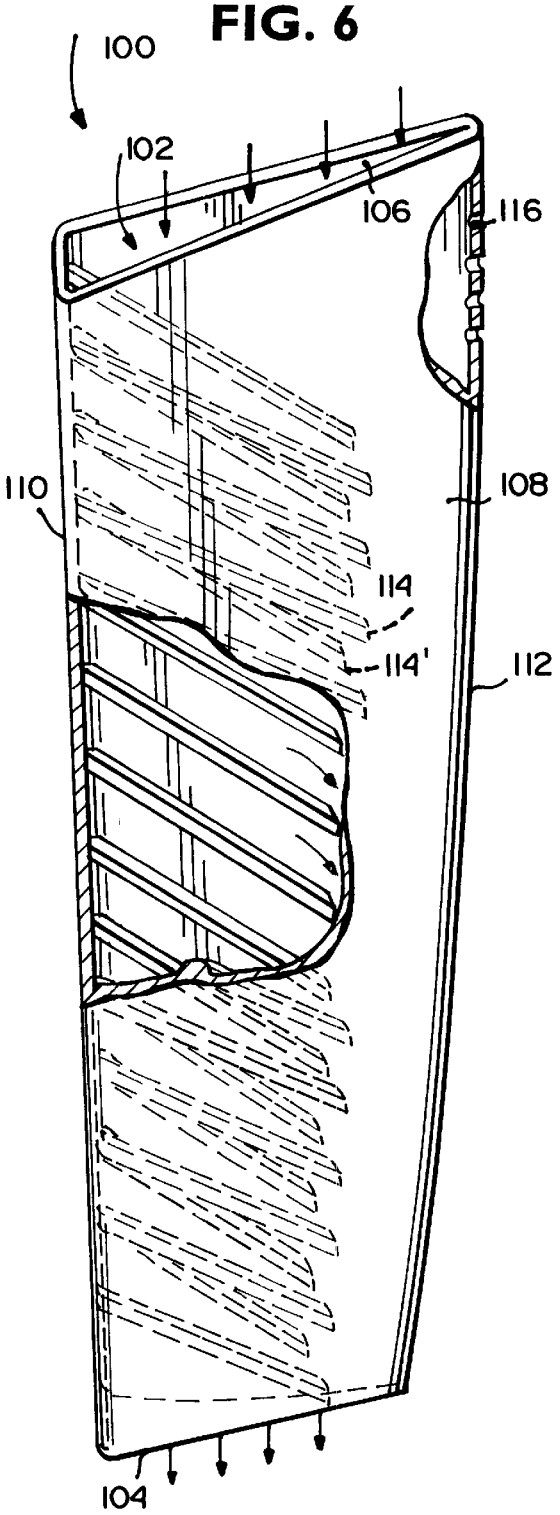
FIG. 6 is a partially cut away perspective view of the airfoil shown in FIG. 5.

Referring now to FIGS. 5 and 6, a third and preferred embodiment is illustrated. Here, the trailing edge cavity 100 has a radial inlet 102 at the radially outer end thereof, and a radial outlet 104 at the radially inner end thereof. As in the earlier described embodiments, the airfoil is hollow and has a substantially triangular cross-section, with side walls 106, 108 converging from a leading wall 110 to a trailing edge 112.

Figure 5B:
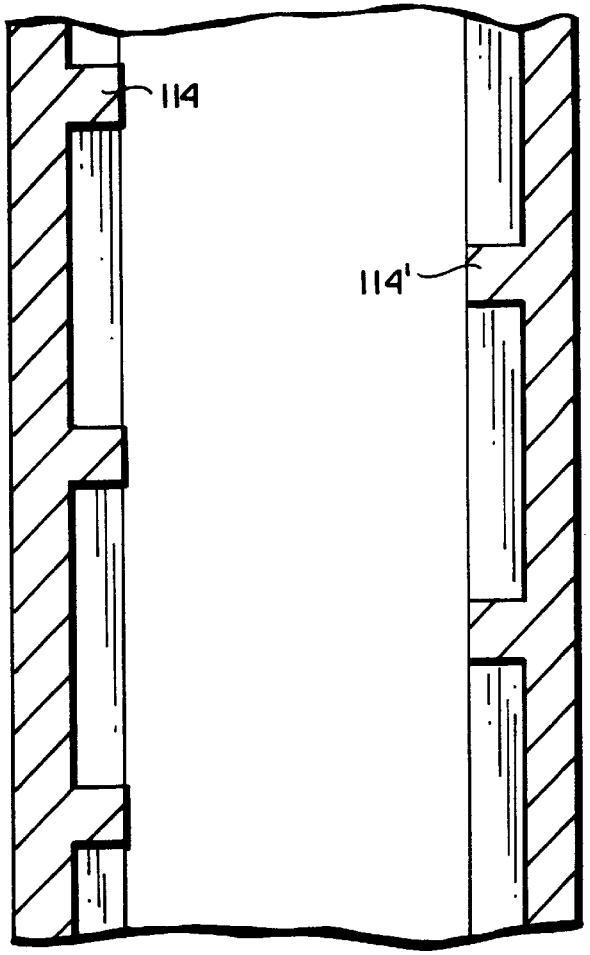
FIG. 5B is an alternative embodiment of the guide vanes of FIG. 5A.
Figure 5A:
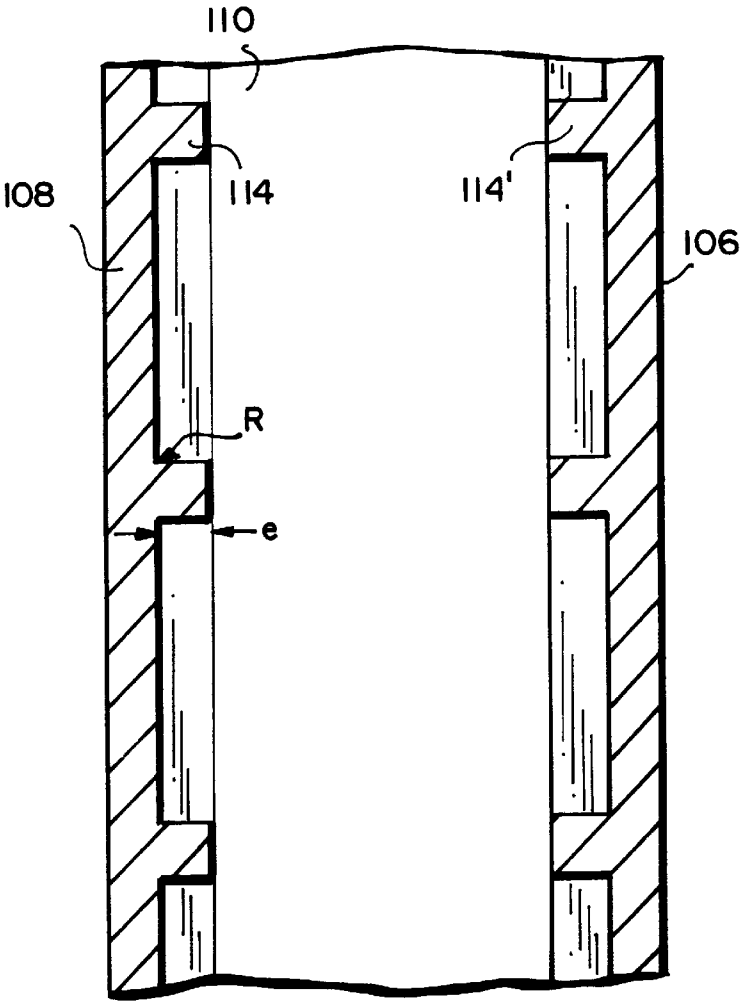
FIG. 5A is a partial cross-sectional view of the airfoil of FIG. 5 illustrating the arrangement of internal guide vanes.

In this embodiment, however, a plurality of guide vanes 114 and 114' are arranged on interior surfaces of the side walls 106, 108 of the cavity. Note that the guide vanes do not extend fully between the side walls, nor do they overlap in a direction transverse to the radial direction of flow. Rather, they project only a relatively small distance from the walls, as best seen in FIG. 5A. This distance "e" is greater than the boundary layer height of the flow passing radially downwardly. Preferably, dimension "e" is three to five times the boundary layer dimension.

The guide vanes 114 and 114' are oriented at about a 45° angle to vertical (but this angle may vary) with the vanes extending downwardly in the flow direction. Vanes 114 and 114' may be arranged as matched and horizontally aligned pairs as shown in FIG. 5A, or they may be horizontally offset as shown in FIG. 5B. The staggered arrangement has been demonstrated to be equally effective and provides the benefit of greater flow cross-sectional area. There are also benefits in terms of the airfoil casting process. At the same time, the length of the guide vanes is preferably between two thirds and three quarters the distance from the leading wall 110 of the cavity to the trailing edge 112.

The repeating pitch from guide vane to guide vane should be greater than 6 times the guide vane height "e" but not greater than 12 times the guide vane height "e", to insure adequate heat transfer pick-up in the primary flow direction. Finally, the ratio of the vane fillet radius R to the guide vane height "e" should not be less than ⅓ to avoid stress concentrations at the root of the guide vane during operation.

With the above arrangement, hot spots behind the guide vanes are eliminated, primarily because the vanes do not extend fully between the side walls 106, 108 of the airfoil. In addition, because the vane dimension "e" is greater than the boundary layer height of the flow passing radially inwardly, flow with lower momentum is trapped and forced to flow toward the apex or trailing edge 112 along substantially the entire length of the vane.

It should also be noted that the cooling flow picks up heat as it passes through the airfoil, causing the boundary layer height to increase. To alleviate the problem to some extent, holes 116 can be provided along the trailing edge 112, particularly in the radially outer region of the airfoil, thus utilizing film cooling along the trailing edge to remove some of the excess heat.

Figure 7:
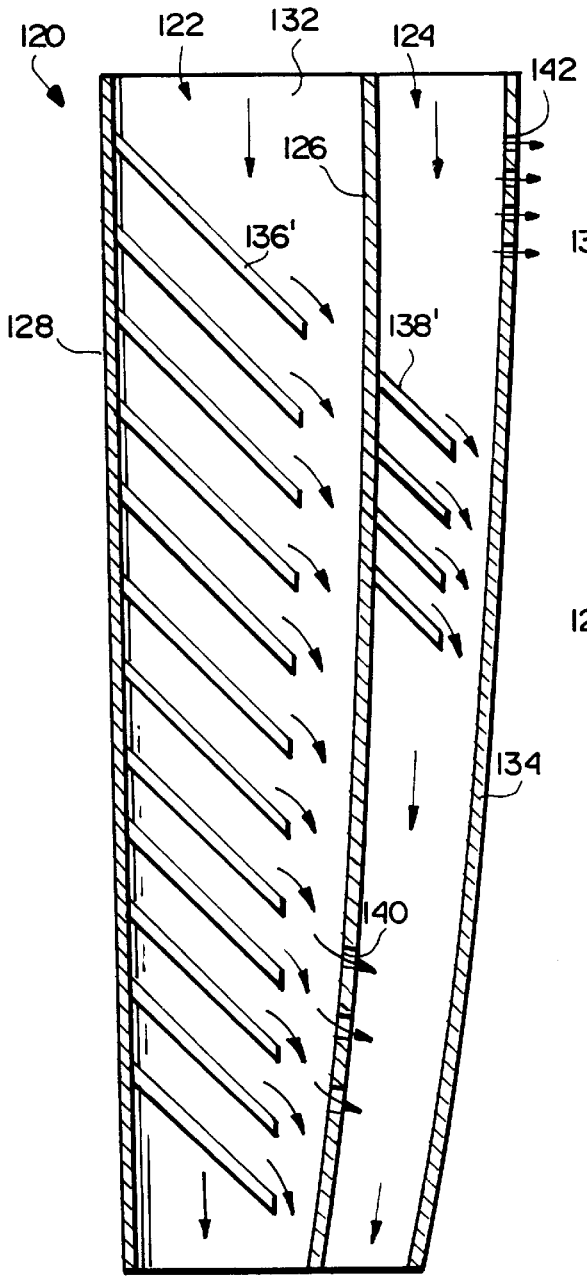
FIG. 7 is a side view, partially cut away, to illustrate an airfoil arrangement similar to that shown in FIG. 5 but with a trailing cavity divided into a pair of smaller cooling passages by a radially extending rib.
Figure 8:
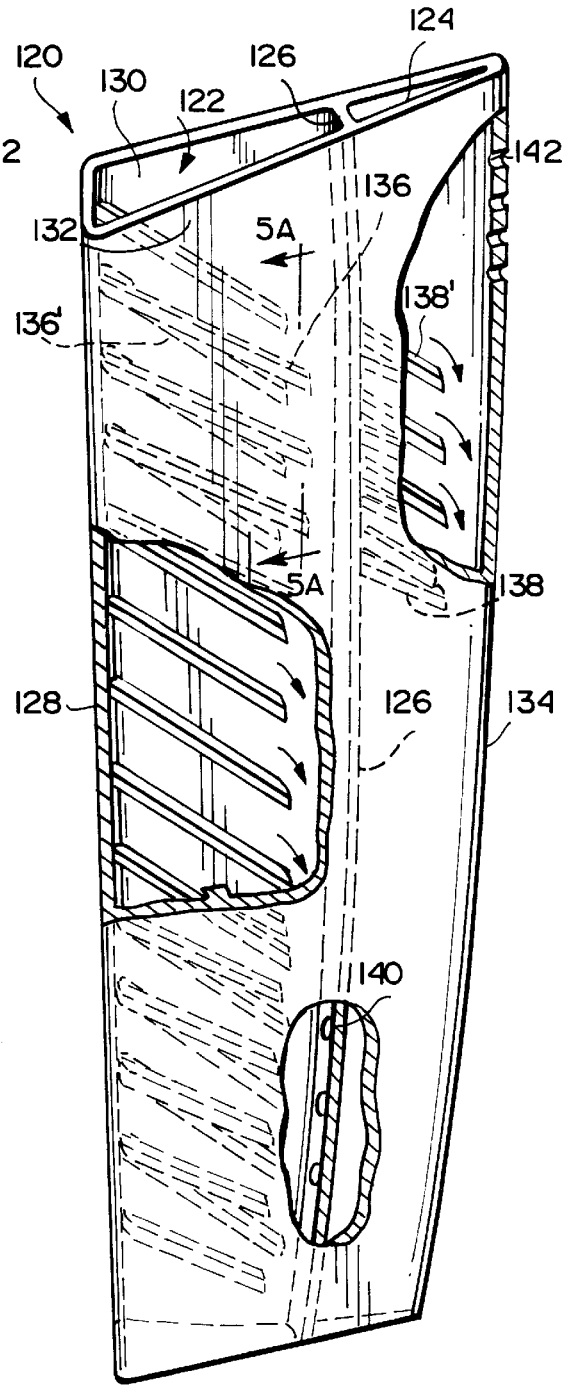
FIG. 8 is a partially cut away perspective view of the airfoil shown in FIG. 7.

Turning now to FIGS. 7 and 8, an alternative preferred embodiment is illustrated which is similar to the embodiment shown in FIGS. 5–6, but wherein the hollow interior of the trailing edge cavity 120 is divided into two smaller passages 122 and 124 by a radially extending partition or rib 126. Thus, one cooling passage 122 is defined by leading wall 128, portions of side walls 130, 132 and the partition or rib 126. The second cooling passage 124 is defined by the rib 126, remaining portions of the side walls 130, 132 and the trailing edge 134.

In the first passage 122, a plurality of guide vanes 136, 136' are arranged similarly to the guide vanes in the embodiment shown in FIGS. 5–6. Here, the guide vanes extend ⅔ to ¾ the length of the first section 122, while a second plurality of guide vanes 138, 138' are similarly arranged in the second cooling section 124, extending from the radial rib or partition 126 toward the trailing edge 134. The arrangement, construction and function of the vanes 136, 136', 138 and 138' are otherwise similar to vanes 114, 114'.

In the illustrated case of two adjacent trapezoidal cavities or cooling passages 122, 124 having the same guide vane arrangement as described above, a plurality of communication holes 140 are provided in the rib or partition 126 to improve the cross flow for improved flow distribution and cooling along the trailing edge 124. Trailing edge holes 142 may be used, if desired, in the same way as holes 116 described above.

The above described arrangement effectively distributes the flow and heat transfer pickup towards the apex of the trailing edge passage. The trailing edge 134 of the cooling passage is where the cooling gas is subjected to the largest external heat fluxes and the lowest internal projected area for cooling. Thus, effective means for cooling as provided by the invention, are particularly important.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An airfoil for a gas turbine having a trailing edge cavity formed by a leading wall and a trailing edge connected by a pair of side walls which converge at said trailing edge to define a cooling passage of substantially triangular cross section;

a first plurality of guide vanes projecting into the cavity from a first of said pair of side walls toward the other of said pair of side walls; and a second plurality of guide vanes projecting from the other of said pair of side walls towards the first of said pair of side walls; wherein none of said first and second plurality of guide vanes overlap in a direction transverse to a radial direction of flow of cooling fluid through the airfoil, and further wherein said first and second pluralities of guide vanes extend from said leading wall toward said trailing edge but terminate at free ends, short of said trailing edge.

2. The airfoil of claim 1 wherein each vane of said first and second pluralities of guide vanes projects into the cavity a distance "e" greater than a boundary layer height for the cooling flow.

3. The airfoil of claim 1 wherein the distance "e" is between three and five times the boundary layer height.

4. The airfoil of claim 1 wherein said vanes have a radially spaced repeating pitch between vanes of between 6 and 12 times said distance "e".

5. The airfoil of claim 4 wherein all of the first and second pluralities of vanes extend at about a 45° angle to vertical.

6. The airfoil of claim 1 wherein said first and second pluralities of guide vanes extend between two thirds and three quarters the distance between the leading wall and the trailing edge.

* * * * *